US005920904A

United States Patent [19]

Sapoznick

[11] Patent Number: 5,920,904

[45] Date of Patent: Jul. 13, 1999

[54] TORSO GARMENT

[76] Inventor: Keith Sapoznick, 1645 Red Oak Rd., Williamstown, N.J. 08094

[21] Appl. No.: 09/087,934

[22] Filed: Jun. 1, 1998

[51] Int. Cl.[6] ..... A41B 1/00

[52] U.S. Cl. ..... 2/69; 2/70; 2/124; 2/127; 2/128

[58] Field of Search ..... 2/112, 113, 114, 2/115, 116, 69, 70, 77, 78.3, 124, 127, 128, 913

[56] References Cited

U.S. PATENT DOCUMENTS 4,570,268 2/1986 Freeman ..... 2/114
5,392,466 2/1995 Chou et al. ..... 2/114
5,588,155 12/1996 Baker et al. ..... 2/114
5,661,852 9/1997 Kessler ..... 2/114

*Primary Examiner*—John J. Calvert
*Assistant Examiner*—Gary L. Welch
*Attorney, Agent, or Firm*—Hoffman, Wasson & Gitler, PC

[57] ABSTRACT

An apparatus for providing ease in dressing for patients with shoulder or arm problems, providing doctors with easy access to the injured area is disclosed. The apparatus shows a garment which unzips at the shoulder and down the side. The garment can either be unzipped completely for easy dressing and undressing, or unzipped partially so that the doctor may examine the shoulder area without the garment's removal. The present invention is appropriate for public wear. It can be either sleeveless or short sleeved so that it may fit under or over a cast or sling.

15 Claims, 2 Drawing Sheets

TORSO GARMENT

FIELD OF THE INVENTION

The present invention relates generally to a torso garment, and more specifically, to a garment worn by patients with shoulder or arm problems required to keep their arm in a sling or cast.

BACKGROUND OF THE INVENTION

Individuals with arm or shoulder problems must devise ways to dress which involve little or no motion of the upper torso. In addition, individuals who must keep their arm in a sling or cast may have difficulty dressing, especially if they live alone. Sliding clothing over a sling or cast is awkward and dangerous. Even individuals who have someone to help them to dress must frequently devise slow and tedious processes for getting into and out of conventional clothing.

Even a visit to the physician can become arduous, as removing a shirt so that the doctor can examine the arm and shoulder area can aggravate injury. Since the arm area may be sensitive, pulling a shirt over the patient's head or sliding the arm through a sleeve may be painful.

There exists no reliable means for patients with arm and shoulder problems to remove a shirt without assistance. Furthermore, there exists no effective means for patients with arm and shoulder problems to allow easy access to an injured area for a doctor's examination.

Much of the prior art is designed for wear only in a hospital setting, such as U.S. Pat. No. 4,964,173, issued to Gordon et al. on Oct. 23, 1990, U.S. Pat. No. 4,055,855, issued to Ragone et al. on Nov. 1, 1977, and U.S. Pat. No. 5,133,086, issued to Truitt et al. on Jul. 28, 1992. These garments are often long enough to cover the entire body and do not look appropriate for public wear, due to their material and their insufficient fastening means.

U.S. Pat. No. 3,116,491, issued to R. E. Previdi et al. on Jan. 7, 1964, is a maternity blouse which uses snaps to change front panels of different sizes as the pregnancy progresses.

U.S. Pat. No. 5,564,123, issued to Grassick on Oct. 15, 1996, uses a hook and loop fastening method, such as Velcro, to close the shirt. Such a closure system may pull open too easily for public wear. Additionally, Velcro can be abrasive to the skin, especially if worn for long periods of time.

U.S. Pat. No. 5,564,126, issued to Chou on Oct. 15, 1996, U.S. Pat. No. 5,553,323, issued to Chou et al., and UK Patent No. 2,267,022 A, issued to Chou et al. on Nov. 24, 1993, involve long sleeved shirts which are difficult, sometimes impossible, to fit over a cast. These patents are designed for paralytic patients, and as a result, unzip down each side for complete removal. This unnecessary zipping may be difficult with one arm.

Therefore, a need has been established for a novel apparatus which can provide easy access to an arm or shoulder patient's injured area during a doctor's examination. Moreover, there is a need for a convenient method for such patients to put on and remove their own shirts without further aggravating the injured area.

It is an object of the present invention to create a shirt which arm and shoulder patients can put on and remove easily with one hand.

It is a further object of the present invention to provide an apparatus allowing reliable access to the arm and shoulder area without requiring the patient to remove his or her shirt.

It is another object of the present invention to provide a shirt which can be put on and removed without causing pain to an injured arm or shoulder.

It is also an object of the present invention to provide a shirt which is suitable to be worn in public.

SUMMARY OF THE INVENTION

The present invention discloses a short sleeve or sleeveless garment, designed for public wear, which fastens at the shoulder and down the side of the user's torso. This allows the garment to be completely opened at the side for easy removal or partially for doctor's examinations and physical therapy.

While the present invention may be worn just like a conventional shirt, and unfastened when necessary, it is designed to be fully functional and to appear like a conventional shirt even without being completely fastened. The placement of fastening devices are important to allowing access to the user's torso while the user is wearing the present invention.

DETAILED DESCRIPTION OF THE PREFERRED EMBODIMENT(S)

The present invention can be formed of any garment which is sleeveless or short sleeved. It is the combination of a sleeveless or short sleeved garment with uniquely placed fastening devices which allows the present invention to function.

Figure 1:
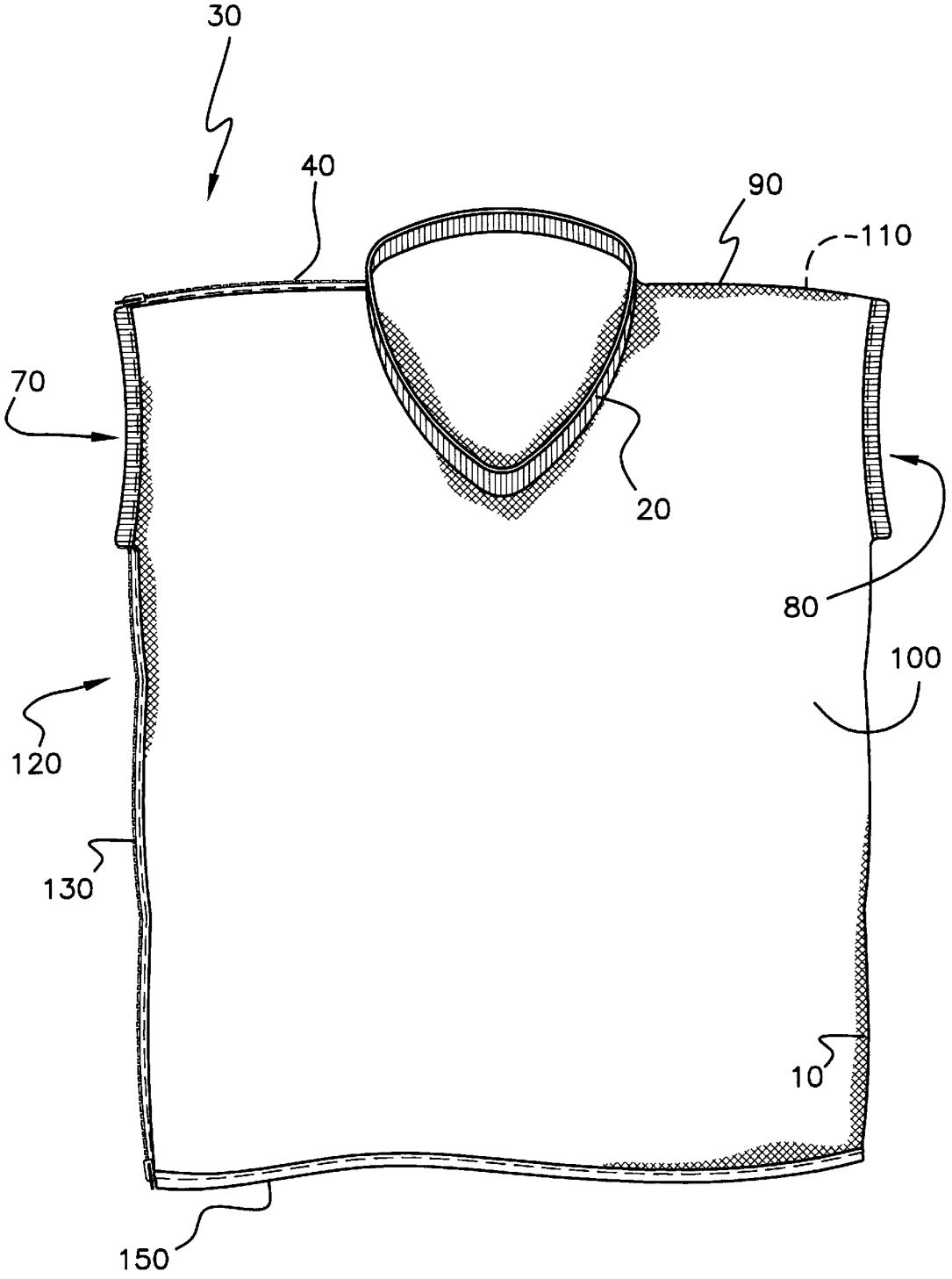
FIG. 1 is a front view of the sleeveless version of the present invention.

Turning to FIG. 1, the preferred embodiment of the present invention is shown. The present invention is, in one embodiment, made of knit fabric (10) with a stretch neck band (20). The knit fabric (10) and the stretch neck band (20) are desirable so that movement and jostling while wearing the present invention will not cause undue stress on an injured area of a user's body. The knit fabric (10) allows the present invention to "give" with any motion of the user's torso.

At the shoulder (30) of the present invention, there is a first fastening device (40), shown in FIG. 1 as a zipper. First fastening device (40) extends from the neck band (20) to the end of the first aperture (70).

Because the present invention is not permanently fastened at the first aperture (70), a second aperture (80) provides structural integrity. At the second aperture (80), there is a seam (90) which connects the present invention's front panel (100) to the present invention's back panel (110).

A second fastening device (130) extends from the first aperture (70) to the bottom end (150) of the present invention. The second fastening device (130) extends down the side (120) of the present invention, so as to appear as unobtrusive as possible.

Figure 2:
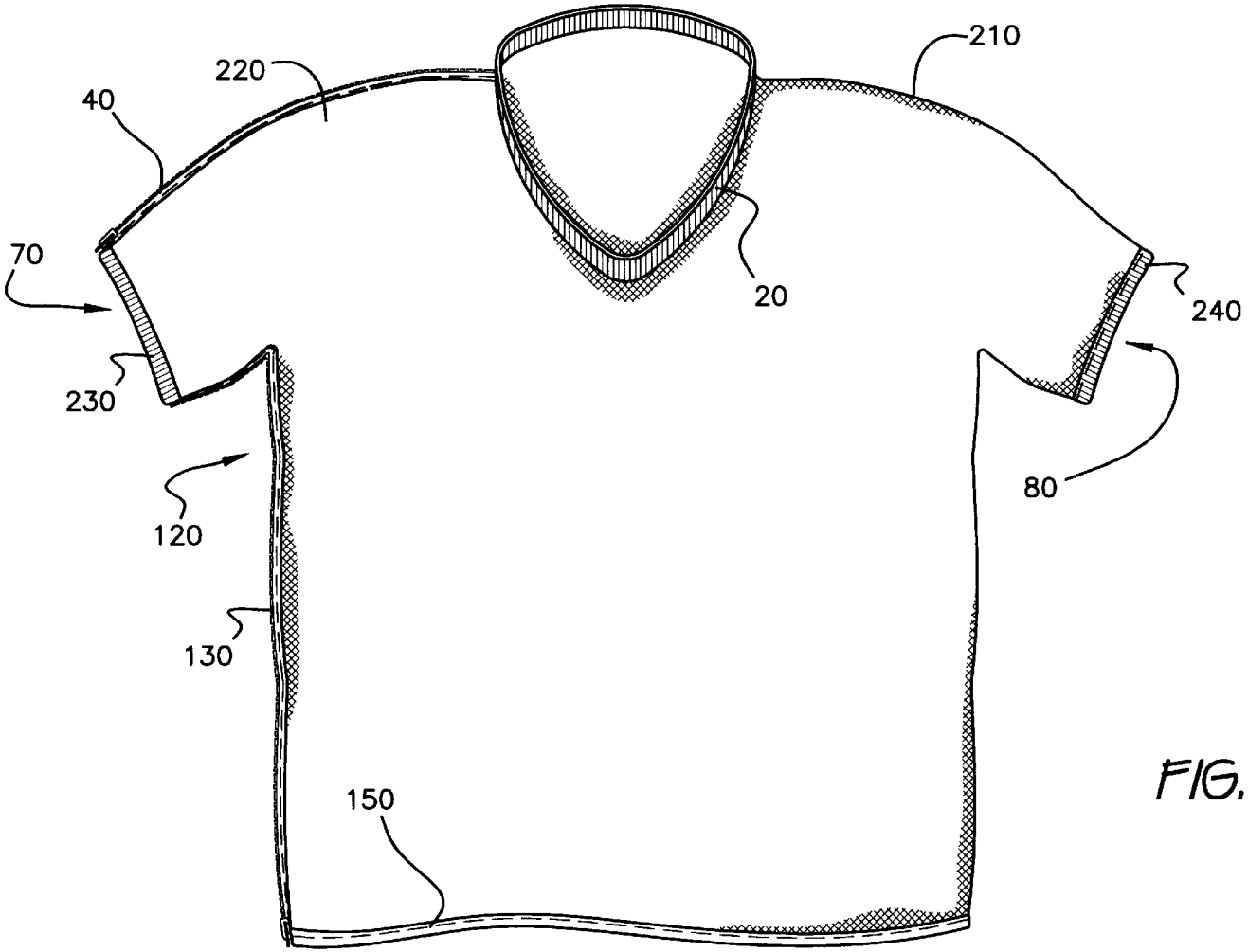
FIG. 2 is a front view of short-sleeved version of the present invention.

FIG. 2 shows a second embodiment of the present invention. Like the first embodiment of the present invention, as shown in FIG. 1, the second embodiment still has a first fastening device (40) extending from the neck band (20) to the first aperture (70). In the second embodiment, however, sleeves (210, 220) serve to provide some covering for a user's shoulders. Sleeves (210, 220) have stretch bands (230, 240) at the first aperture (70) and the second aperture (80).

In use, the present invention can be adjusted to provide unencumbered access to the upper torso and/or removal therefrom. The first fastening device (40) may be a zipper (as shown in FIGS. 1 and 2), a hook and loop type fastener, or other reliable resealing system. The first fastening device (40) can be opened to enlarge the neck (20). Alternatively, the second fastening device (130) can be opened to enlarge the first aperture (70) and/or the bottom end (150). Depending upon the injured area of a user's torso, either or both fastening devices (40, 130) can be opened to allow easy access and controlled fit to a user's body.

The stretch neck band (20) is important so that a user can quickly and easily slide the present invention off over the head without tearing or destroying the neck band (20). Also, users having serious injuries might desire to employ merely the neck band (20) and almost completely opened fastening devices (40, 130) to allow the present invention to remain on their torso. In such a configuration, the present invention would appear as a conventional shirt from the distance, and fastening devices (40, 130) would only be apparent upon close examination; yet, great and unrestricted movement of the torso would be possible.

Sleeves (210, 220) are important structural considerations of the present invention because they allow the second fastening device (130) to be fully opened while allowing the present invention to still maintain a conventional shirt-type appearance. The sleeves (210, 220) prevent the present invention from gaping at the side (120) when the second fastening device (130) is completely opened.

I claim:

1. An apparatus for covering the torso comprising:

a material coincident with a substantial portion of the torso having an anterior and posterior end;

a neck band, formed at the anterior end of said material;

a first aperture, lateral of said neck band;

a first fastening device extending from said neck band to said first aperture; and a second fastening device extending from said first aperture to the posterior end of said material;

wherein said first fastening device and said second fastening device are separated by said first aperture.

2. The apparatus, as in claim 1, wherein said material is a knit fabric.

3. The apparatus, as in claim 1, wherein said neck band is stretchable.

4. The apparatus, as in claim 1, wherein said first fastening device is a zipper.

5. The apparatus, as in claim 1, further comprising a second aperture lateral of said neck band and opposite said first aperture.

6. The apparatus, as in claim 5, further comprising a seam running from said second aperture to said neck band.

7. The apparatus, as claimed in claim 5, further comprising a second sleeve between said neck band and said second aperture.

8. The apparatus, as claimed in claim 5, further comprising a stretch band circumscribing said second aperture.

9. The apparatus, as claimed in claim 1, wherein said second fastening device is a zipper.

10. The apparatus, as claimed in claim 1, wherein said first fastening device is linear.

11. The apparatus, as claimed in claim 1, wherein said second fastening device is linear.

12. The apparatus, as claimed in claim 1, further comprising a first sleeve between said neck band and said first aperture.

13. The apparatus, as claimed in claim 1, further comprising a stretch band circumscribing said first aperture.

14. The apparatus, as in claim 1, wherein said first fastening device is a hook and loop type fastener.

15. The apparatus, as in claim 1, wherein said second fastening device is a hook and loop type fastener.

* * * * *